US006219518B1

(12) United States Patent
Sugiyama et al.

(10) Patent No.: US 6,219,518 B1
(45) Date of Patent: Apr. 17, 2001

(54) IMAGE FORMING APPARATUS INCLUDING AN INTERMEDIATE IMAGE TRANSFER BODY

(75) Inventors: Naoki Sugiyama; Mitsuru Seto, both of Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 09/431,280

(22) Filed: Nov. 1, 1999

(30) Foreign Application Priority Data

Oct. 30, 1998 (JP) ..... 10-309903

(51) Int. Cl.[7] ..... G03G 15/16
(52) U.S. Cl. ..... 399/313
(58) Field of Search ..... 399/297, 302, 399/310, 313, 318, 308

(56) References Cited

U.S. PATENT DOCUMENTS

| | | | | |
|---|---|---|---|---|
| 5,010,370 | * | 4/1991 | Araya et al. | 399/313 X |
| 5,438,398 | * | 8/1995 | Tanigawa et al. | 399/302 |
| 5,669,053 | * | 9/1997 | Hashizume et al. | 399/313 |
| 5,778,281 | * | 7/1998 | Handa | 399/313 X |
| 5,819,142 | * | 10/1998 | Murata et al. | 399/313 X |
| 5,857,132 | * | 1/1999 | Mizuishi et al. | 399/313 X |
| 5,978,639 | * | 11/1999 | Masuda et al. | 399/302 |

FOREIGN PATENT DOCUMENTS

| | | |
|---|---|---|
| 6-19276 | 1/1994 | (JP) . |
| 8-87156 | 4/1996 | (JP) . |
| 8-234564 | 9/1996 | (JP) . |
| 10-78713 | 3/1998 | (JP) . |
| 10-228187 | 8/1998 | (JP) . |
| 11-38782 | 2/1999 | (JP) . |

* cited by examiner

*Primary Examiner*—Sandra Brase
(74) *Attorney, Agent, or Firm*—Oblon, Spivak, McClelland, Maier & Neustadt, P.C.

(57) ABSTRACT

An image forming apparatus of the type sequentially transferring a plurality of toner images formed on an image carrier to an intermediate image transfer body one upon the other (primary transfer) and collectively transferring them from the intermediate image transfer body to a recording medium (secondary transfer) is disclosed. The intermediate image transfer body is implemented by a roller including a metallic core, a base layer formed on the core, and a surface layer formed on the base layer. The base layer and surface layer have a total resistance between $1.57\times10^{8}$ Ω and $1.57\times10^{9}$ Ω for a unit length (1/cm). The surface layer has a volume resistivity between $1\times10^{6}$ Ω cm and $1\times10^{9}$ Ω cm. The roller is free from defective image transfer ascribable to the varying environment.

6 Claims, 5 Drawing Sheets

*Fig. 3*

| ROLLER NO. | 1 | 2 | 3 | 4 | 5 | 6 |
|---|---|---|---|---|---|---|
| VOLUME RESISTIVITY OF SURFACE LAYER (Ω cm) | $5\times10^{5}$ | $1\times10^{6}$ | $2\times10^{8}$ | $1\times10^{9}$ | $5\times10^{11}$ | $2\times10^{13}$ |
| OPTICAL TRANSFER BIAS RANGE (V) | X | 100 | 250 | 100 | X | X |

IMAGE FORMING APPARATUS INCLUDING AN INTERMEDIATE IMAGE TRANSFER BODY

BACKGROUND OF THE INVENTION

The present invention relates to a copier, printer, facsimile apparatus or similar electrophotographic image forming apparatus and more particularly to an image forming apparatus of the type sequentially transferring toner images from an image carrier to a belt or similar intermediate image transfer body one upon the other (primary transfer) and collectively transferring them from the intermediate transfer body to a paper or similar recording medium (secondary transfer), and the intermediate transfer body.

Today, in the electrophotographic imaging art, image transfer using a belt or a roller is replacing traditional corona image transfer from the environmental standpoint. The present invention relates to image transfer using an image transfer roller.

Various kinds of technologies have heretofore been proposed in relation to an image transfer roller. For example, an image transfer roller may be implemented by a sponge roller having a specific hardness for reducing a nip pressure. This transfer roller is directed toward an image free from vermicular defects. The surface of an image transfer roller may have its specific resistance increased in order to prevent an image transfer voltage from varying with the varying environment, e.g., the resistance of a recording medium, as taught in Japanese Patent Laid-Open Publication No. 2-212873.

At the time of secondary transfer following primary transfer, an optimal image transfer current to be applied to the image transfer roller is determined by the transfer characteristic of a sol id portion and that of a halftone portion. That is, a current satisfying both of such characteristics has customarily been selected as an optimal image transfer current. In a low temperature, low humidity environment, it is a common practice to increase a bias to be applied to the roller also because the resistance of a recording medium increases in the above environment.

However, the conventional image transfer roller has the following problems when used in the above conditions. Desirable image transfer is not achievable because the range of optimal currents is extremely narrow or does not exist at all, i.e., the transfer characteristic of a solid portion and that of a halftone portion cannot be implemented at the same time. Further, because the resistance of the roller susceptible to the environment, it is necessary to use a power pack having an extremely great capacity or to heat the roller or otherwise prevent the resistance of the roller from increasing.

Technologies relating to the present invention are also disclosed in, e.g., Japanese Patent Laid-Open Publication Nos. 6-19276, 8-87156, 8-234564, 10-78713, 10-228187, and 11-38782.

SUMMARY OF THE INVENTION

It is therefore an object of the present invention to provide an image forming apparatus capable of achieving a sufficient margin as to a transfer current for secondary transfer which is severest in a low temperature environment causing the resistance of a recording medium to rise, and insuring desirable image transfer without resorting to a power pack having an extremely great capacity or the heating of a roller in a low temperature environment conventionally effected to suppress an increase in resistance, and an image transfer roller therefor.

In accordance with the present invention, in an image forming apparatus for sequentially transferring a plurality of toner images formed on an image carrier to an endless intermediate image transfer body one upon the other for thereby effecting primary transfer, and collectively transferring the toner images from the intermediate image transfer body to a recording medium for thereby effecting secondary transfer, an image transfer roller for the secondary transfer includes a metallic core and at least two layers formed on the metallic core and including a base layer formed on the metallic core and a surface layer formed on the base layer. The two layers have a resistance between $1.57\times10^{6}$ Ω and $1.57\times10^{9}$ Ω for a unit length (1/cm) while the surface layer has a volume resistivity between $1\times10^{6}$ Ω cm and $1\times10^{9}$ Ω cm.

BRIEF DESCRIPTION OF THE DRAWINGS

The above and other objects, features and advantages of the present invention will become more apparent from the following detailed description taken with the accompanying drawings in which:

FIG. 3 is a table listing the volume resistivities of surface layers included in image transfer rollers #1 through #6 and optimal transfer bias ranges;

DESCRIPTION OF THE PREFERRED EMBODIMENT

Figure 1:
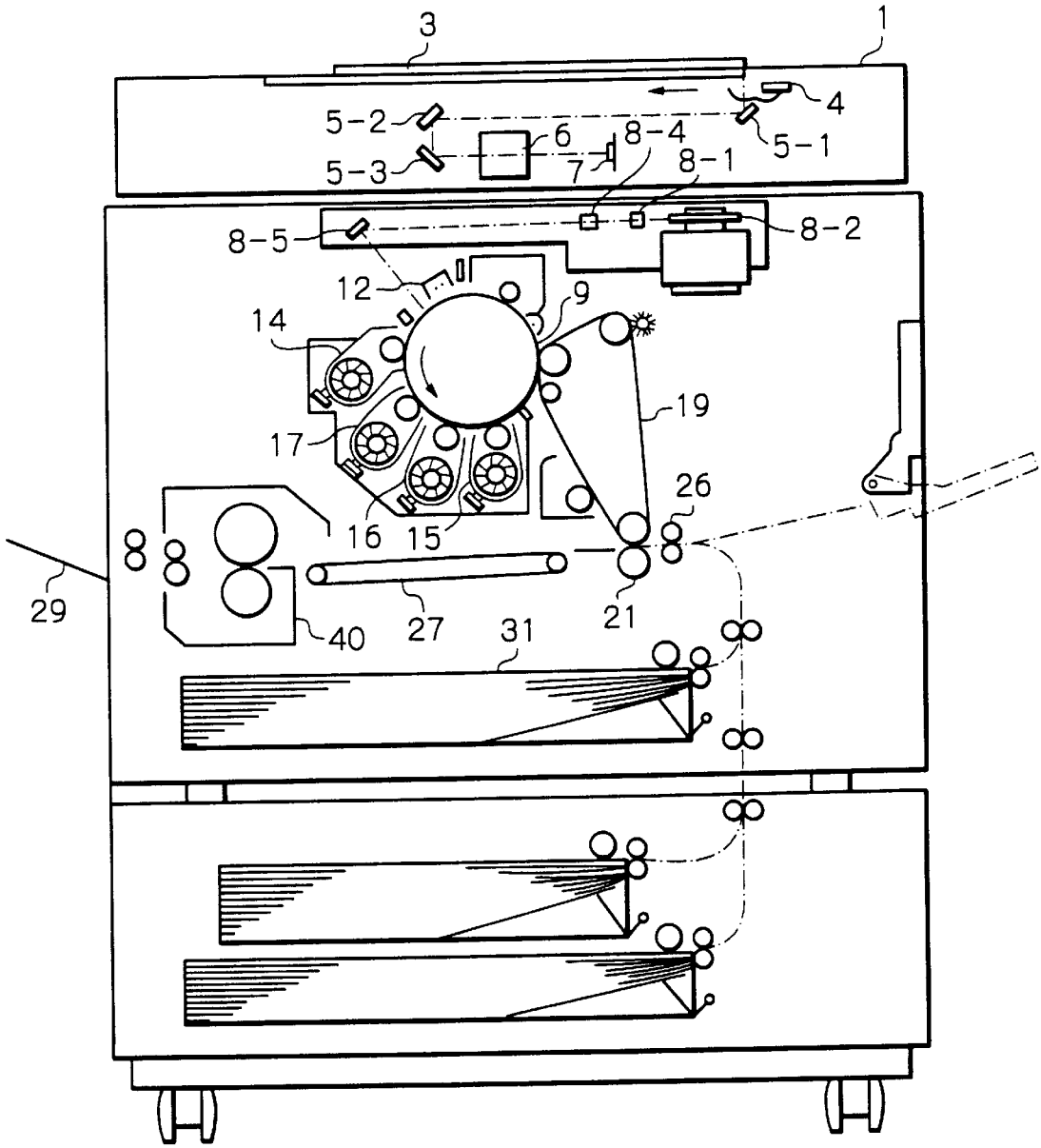
FIG. 1 is a view showing an image forming apparatus to which the present invention is applicable.

Referring FIG. 1 of the drawings, an image forming apparatus to which the present invention is applicable is shown and includes a color scanner or color image reading device 1. The color scanner 1 reads a document 3 by being driven by a stepping motor not shown. Specifically, when a lamp 4 included in the color scanner 1 illuminates the document 3, the resulting imagewise reflection from the document 3 is incident to a color image sensor 7 via mirrors 5-1, 5-2 and 5-3 and a lens 6. The image sensor 7 transforms the incident light to electric signals representative of, e.g., a blue component, a green component and a red component. An image processing section, not shown, converts the blue, green and red components to black (BK), cyan (C), magenta (M) and yellow (Y) color image data on the basis of the intensity level of the electric signal.

A laser beam derived from the BK color data or color image signal scans an image carrier 9 via a polygonal mirror 8-2, f/θ optics 8-1 and 8-4 and a mirror 8-5. The image carrier 9 is implemented by a photoconductive drum and uniformly charged beforehand. As a result, the laser beam electrostatically forms a BK latent image on the charged surface of the image carrier 9. A BK developing unit 14 develops the BK latent image with BK toner to thereby form a BK toner image. The BK toner image is transferred from the image carrier 9 to an intermediate image transfer body 19. The apparatus repeats such a procedure with each of the C, M and Y color image signals, sequentially transferring a C, an M and a Y toner image to the intermediate image transfer body 19 one upon the other (primary transfer). Consequently, a full-color toner image corresponding to the document image is completed on the intermediate image transfer body. In FIG. 1, the reference numerals 17, 16 and 15 designate a C, an M and a Y developing unit, respectively.

A paper or similar recording medium is fed from a tray 31 to a pair of registration rollers 26. The registration rollers 26 convey the sheet at a preselected timing. An image transfer roller 21 embodying the present invention collectively transfers the full-color toner image from the intermediate transfer body 19 to the paper (secondary transfer). A conveyor unit 27 conveys the paper carrying the toner image thereon to a fixing unit 40. After the fixing unit 40 has fixed the toner image on the paper with heat and pressure, the paper is driven out to a tray 29.

Figure 2A:
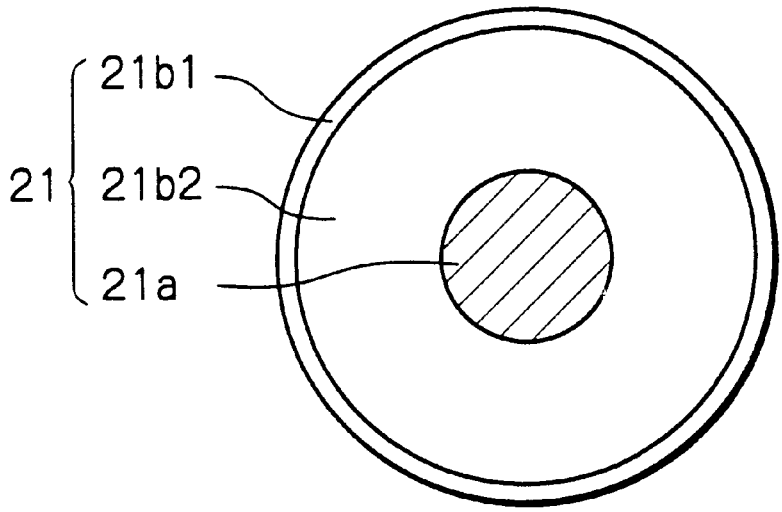
FIGS. 2A and 2B are sectional views each showing a particular configuration of a base layer included in an image transfer roller embodying the present invention.
Figure 2B:
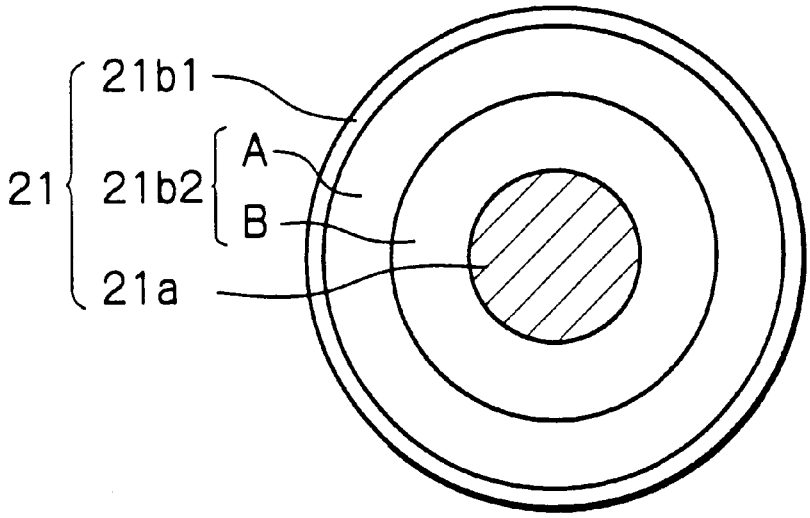

As shown in FIG. 2A, the image transfer roller 21 is made up of a metallic core 21*a,* a base layer 21*b*2 formed on the core 21*a,* and a surface layer 21*b*1 formed on the base layer 21*b*2. As shown in FIG. 2B, the base layer 21*b*2 may have a laminate structure made up of two layers A and B or three or more layers. A thin adhesive layer intervenes between the core 21*a* and the base layer 21*b*2 and between the base layer 21*b*2 and the surface layer 21*b*1, as needed, although not shown specifically. A thin adhesive layer, not shown, also intervenes between the two layers A and B.

A bias power source, not shown, is connected to the metallic core 21*a* for applying a bias for image transfer thereto. The base layer 21*b*2 and surface layer 21*b*1 each have at least two layers including the adhesive layer and implemented by one or both of rubber and resin.

In the following description, only the base layer 21*b*2 obtained surface layer 21*b*1, as well as an adhesive layer if present therebetween, are considered to constitute the resistance of the image transfer roller 21. The illustrative embodiment achieves unprecedented advantages by confining each of the resistance of the roller 21 and the volume resistivity of the surface layer 21*b*1 in a particular range. Specifically, the results of the following experiments showed that the volume resistivity of the surface layer 21*b*1 was closely related to the margin of an optimal image transfer current in a low temperature, low humidity environment.

To examine image transferability under various conditions, six image transfer rollers #1 through #6 shown in FIG. 3 were produced, and each included a single base layer 21*b*2, FIG. 2A. The base layer 21*b*2 was formed of ethylene-propylene dienemethyl rubber (EPDM). The base layers 21*b*2 of the rollers #1 through #6 had resistances adjusted in the range of from $7\times10^5$ Ω to $3\times10^5$ Ω by the addition of carbon. The rubber layers each were 314 mm long in the axial direction.

To form the surface layers 21*b*1, fluorocarbon resins having different specific resistances implemented by different amounts of dispersed carbon were respectively applied to the base layers 21*b*2 of the rollers #1 through #6 by spray coating such that the resins were 15 μm to 20 μm thick when cured. The surface layers 21*b*1 of the rollers #1 through #6 respectively had volume resistivities of $5\times10^5$ Ω cm, $1\times10^6$ Ω cm, $2\times10^8$ Ω cm, $1\times10^9$ Ω cm, $5\times10^{11}$ Ω cm and $2\times10^{13}$ Ω cm, as shown in FIG. 3.

The above rollers #1 through #6 were sequentially mounted to an image forming apparatus PRETER 600 (trade name) available from Ricoh Co., Ltd. and having the construction shown in FIG. 1. The rollers #1 through #6 each were connected to a bias power source not shown. The bias for secondary transfer was varied roller by roller in a suitable range in a 10° C., 15% RH (Relative Humidity) environment so as to estimate an optimal bias range satisfying both of the transfer characteristic of a solid portion and that of a halftone portion. The optimal bias range refers to the range of voltages (V) realized desirable image transfer at both sides of a reference voltage. Optimal bias ranges obtained with the rollers #1 through #6 are also shown in FIG. 3. As for primary transfer, conditions particular to the above test machine as specifications were not changed.

In FIG. 3, crosses indicate that the optimal bias range satisfying both of a solid portion and a halftone portion was not achieved with the rollers #1, #5 and #6. The optimal bias ranges of 100 V and 250 V shown in FIG. 3 show that the rollers #2, #3 and #4 each satisfied both of the transfer characteristic of a solid portion and that of a halftone portion.

As FIG. 3 indicates, volume resistivities ranging from $1\times10^6$ Ω cm to $1\times10^9$ Ω cm particular to the rollers #2, #3 and #4 are satisfactory. Volume resistivities lower or higher than the above range cannot desirably transfer a solid portion or a halftone portion. In the desirable volume resistivity range of from $1\times10^6$ Ω cm to $1\times10^9$ Ω cm, resistivities around $2\times10^8$ Ω cm are particularly preferable because they implement a great margin as to the optimal transfer bias and thereby broaden the range of applicable conditions.

Figure 4:
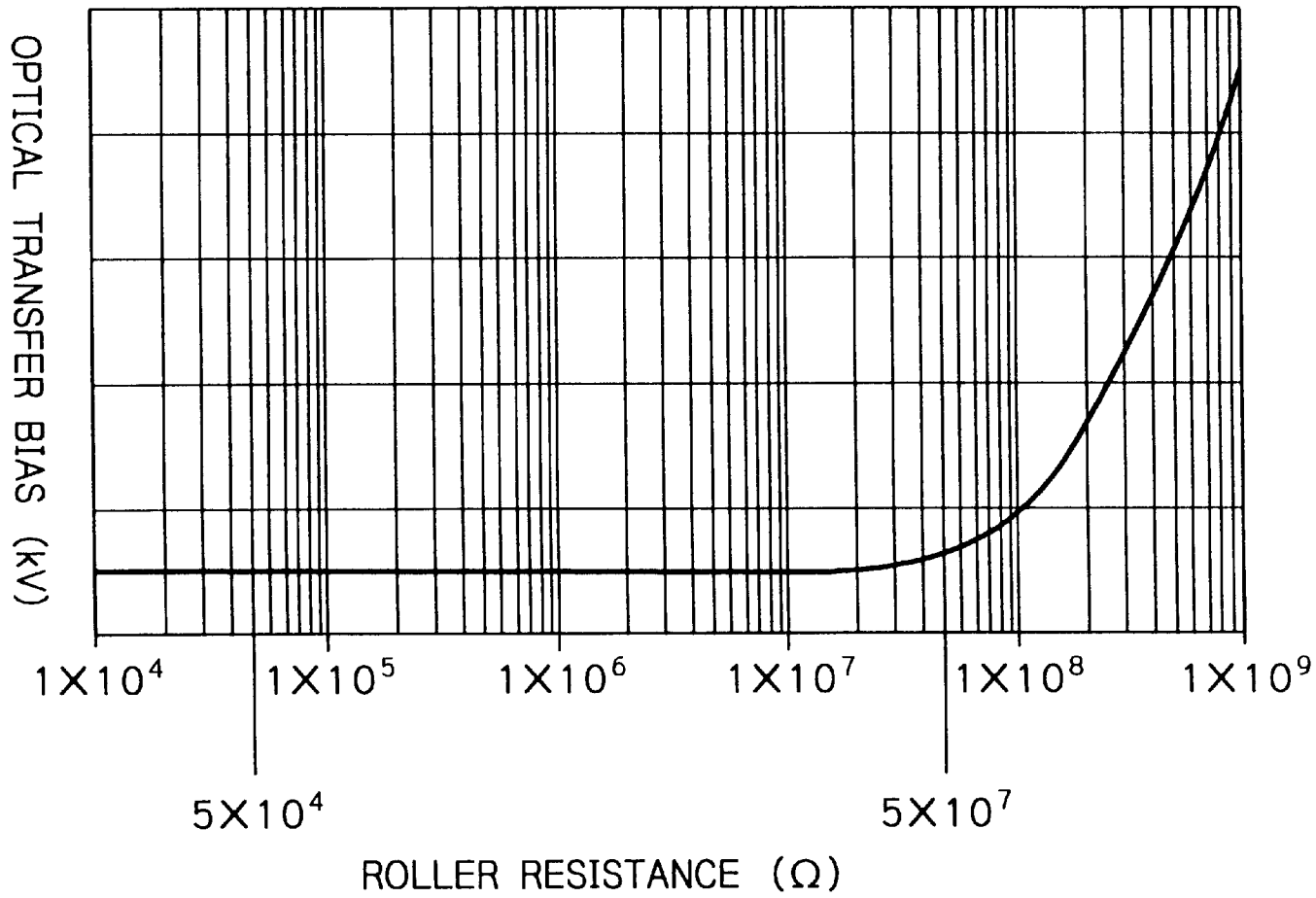
FIG. 4 is a graph showing a relation between the roller resistance and the optimal transfer bias.

FIG. 4 shows a relation between the resistance of the image transfer roller, i.e., the resistance of the surface layer 21*b*1 and base layer 21*b*2 and the optimal transfer bias (kV). Specifically, image transfer rollers having roller resistances of $1\times10^4$ Ω to $1\times10^9$ Ω were mounted to the previously mentioned test machine for executing secondary transfer. FIG. 4 plots optimal transfer biases (kV) realized desirable secondary transfer and obtained with the above rollers. The surface layer 21*b*1 and base layer 21*b*2 of each roller were also 314 mm long in the axial direction.

As shown in FIG. 4, the optimal transfer bias remains substantially the same up to the roller resistances of up to $5\times10^7$ Ω, but begins to rise little by little when the roller resistance exceeds $5\times10^7$ Ω. When the roller resistance exceeds $1\times10^8$ Ω, the optimal transfer bias sharply increases. Specifically, even when the resistance of the base layer 21*b*2 or that of the surface layer 21*b*2 is irregular, roller resistances lower than $5\times10^7$ Ω can satisfy both of a solid portion and a halftone portion without changing the set transfer bias. However, roller resistances higher than $5\times10^7$ Ω require the set transfer bias to be changed or cause irregular transfer to occur within a single roller.

Assume an image transfer roller whose roller layer 21*b* has a resistance of $1\times10^7$ Ω in a 30° C., 90% RH environment and a resistance of $5\times10^8$ Ω in a 10° C., 15% RH environment by way of example. With this kind of roller, it is necessary to, e.g., assign a particular transfer bias to each of the high temperature, high humidity environment (30° C. and 90% RH) and low temperature, low humidity environment (10° C. and 15% RH) or to heat the roller in the low temperature, low humidity environment in order to reduce the resistance of the roller layer to $5\times10^7$ Ω or lower.

It follows that if the resistance of the image transfer roller is $5\times10^7$ Ω or lower, troublesome operations ascribable to the varying environment and including the change of the set transfer bias or the heating of the roller are not necessary. In the illustrative embodiment, the image transfer roller 21 includes at least two layers, i.e., surface layer 21*b*1 and base layer 21*b*2, so that the resistance of the roller is at least the sum of the resistance of the layer 21*b*1 and that of the layer 21*b*2.

The volume resistivity of the surface layer 21*b*1 should preferably be between $1\times10^6$ Ω cm and $1\times10^9$ Ω cm, as stated earlier with reference to FIG. 3. When the surface layer 21*b*1 having such a volume resistivity is combined with the base layer 21*b*2 implementing a roller resistance lower than $5\times10^4$ Ω, the specific resistance of the base layer 21*b* is excessively low. As a result, the transfer current turns round in a low temperature, low humidity environment in which the resistance of a recording medium increases, or at the edges of the medium in a duplex copy mode, bringing about defective image transfer.

It follows that the 314 mm long roller layer 21*b* should preferably have a resistance between $5\times10^4$ Ω and $5\times10^7$ Ω in order to stabilize the optimal bias relative to the resistance of the roller layer 21*b* and to obviate defective transfer at the edges of a recording medium. The illustrative embodiment therefore provides the surface layer 21*b*1 with a volume resistance of $1\times10^6$ Ω cm to $1\times10^9$ Ω cm and provides the image transfer roller with a resistance of $1.57\times10^6$ Ω to $1.57\times10^9$ Ω for a unit length (1/cm).

Figure 5:
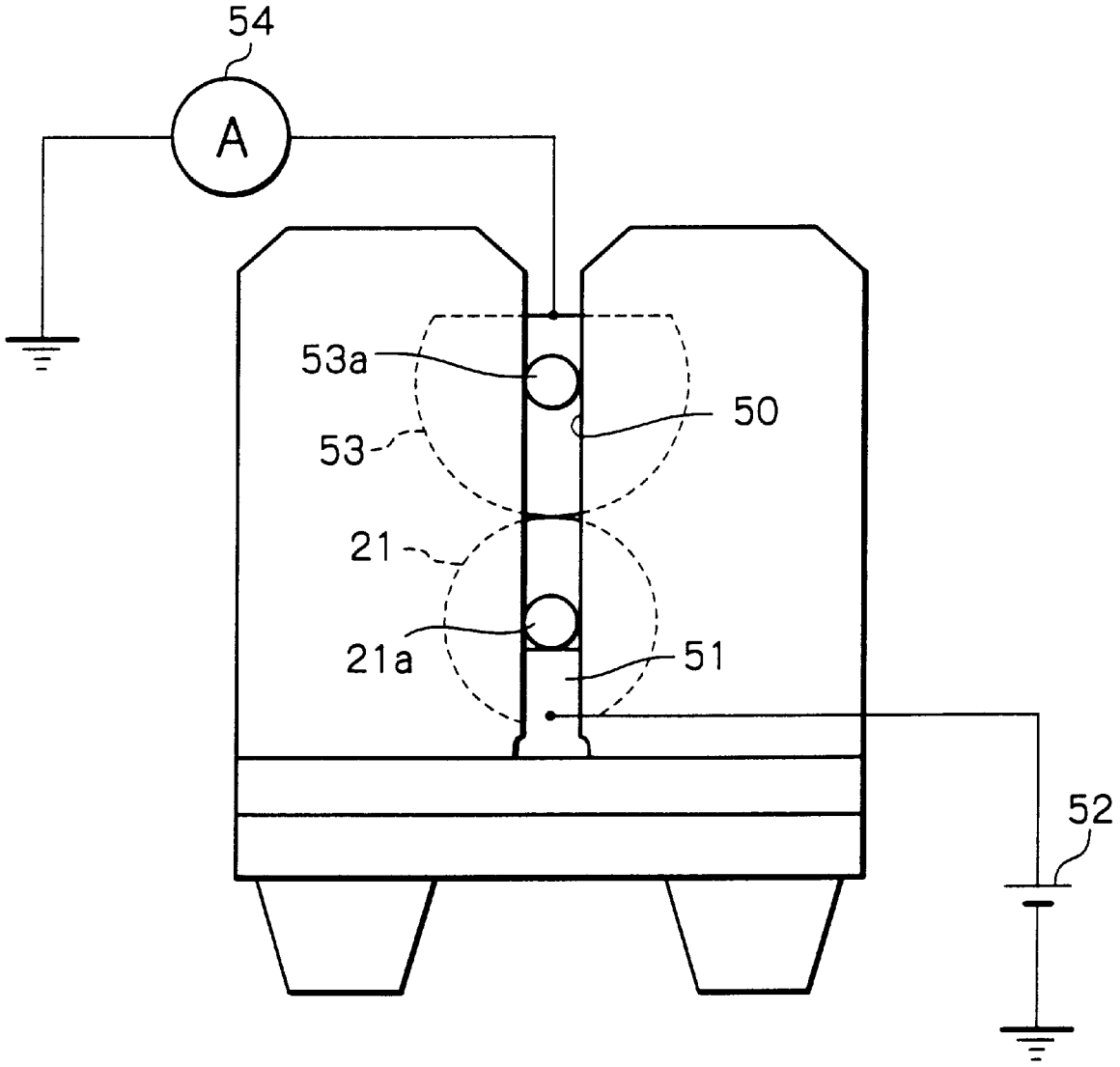
FIG. 5 is a view showing a specific arrangement for measuring the resistance of the image transfer roller.

FIG. 5 shows a specific arrangement used to measure the resistance of the image transfer roller 21. As shown, an apparatus for measuring the resistance is formed with a vertical channel 50 for slidably supporting the shaft (core) of the roller 21. A leaf spring 51 playing the role of an electrode is positioned at the bottom of the channel 50. A power source 52 is connected to the leaf spring 51. First, the core 21*a* of the roller or sample 21 is inserted into the channel 50 until the roller 21 rests on the leaf spring 51 due to its own weight. Subsequently, a roller 56 for detecting a current and serving as a weight at the same time has its core 53*a* inserted into the channel 50. The roller 56 rests on the transfer roller 21 due to its own weight. The roller 56 is connected to ground via an ammeter 54.

In the above condition, a DC voltage of 1 kV was applied to the power source 52, and then the ammeter 54 was read in 30 seconds. The voltage of 1 kV was divided by a current read on the ammeter 54 to produce the resistance of the roller 21.

Conductive rubber applicable to the base layer 21*b*2 is generally classified into electron conductive rubber and ion conductive rubber. Electron conductive rubber has resistance little susceptible to the environment although its resistance is noticeably irregular. On the other hand, ion conductive rubber is sparingly irregular in resistance although its resistance is susceptible to the environment.

Particularly, epichlorohydrin rubber and urethane rubber belonging to a family of ion conductive rubber are extensively used to produce rubber rollers because they vary in resistance by only about 1.5 figure against the varying environment (10° C., 15% RH to 30° C., 90% RH) and has a minimum of scatter in resistance among rollers and in a single roller.

However, the problem with an image transfer roller formed of epichlorohydrin rubber or urethane rubber is that its resistance is $1\times10^8$ Ω or higher in the 10° C., 15% RH environment which does not lie in the desirable range of from $5\times10^4$ Ω to $5\times10^7$ Ω.

An image transfer roller with a base layer implemented by ion conductive rubber containing polyether amide (PEA), polyether-ester amide (PEEA) is free form the problem of the above roller. However, this kind of roller is not practical because its resistance noticeably varies with humidity.

It will be seen from the above that if the resistance of the roller for a unit length (1/cm) is between $1.57\times10^6$ Ω and $1.57\times10^9$ Ω and if the base layer 21*b*2 is formed of electron conductive rubber, it is possible to overcome the demerit of the electron conductive rubber and that of the ion conductive rubber at the same time.

In summary, in accordance with the present invention, it is possible to achieve a sufficient margin as to a transfer current for secondary transfer which is severest in a low temperature environment causing the resistance of a recording medium to rise. Further, the present invention insures desirable image transfer without resorting to a power pack having an extremely great capacity or the heating of a roller in a low temperature environment effected to suppress an increase in resistance.

Various modifications will become possible for those skilled in the art after receiving the teachings of the present invention without departing from the scope thereof.

What is claimed is:

1. In an image forming apparatus for sequentially transferring a plurality of toner images formed on an image carrier to an endless intermediate image transfer body one upon the other for thereby effecting primary transfer, and collectively transferring said toner images from said intermediate image transfer body to a recording medium for thereby effecting secondary transfer, an image transfer roller for said secondary transfer includes a metallic core and at least two layers formed on said metallic core and including a base layer formed on said metallic core and a surface layer formed on said base layer, said at least two layers having a resistance between $1.57\times10^6$ Ω and $1.57\times10^9$ Ω for a unit length (1/cm), said surface layer having a volume resistivity between $1\times10^6$ Ω cm and $1\times10^9$ Ω cm.

2. An apparatus as claimed in claim 1, wherein said base layer is formed of electron conductive rubber.

3. The apparatus of claim 1, wherein said base layer comprises ethylene-propylene dienemethyl rubber.

4. The apparatus of claim 1, wherein said surface layer comprises a fluorocarbon resin.

5. A method for effecting secondary transfer of a toner image from an endless intermediate image transfer body to a recording medium comprising a) transferring a toner image from an endless intermediate image transfer body to a recording medium using an image transfer roller, wherein said image transfer roller comprises:

i) a metallic core; and ii) at least two layers formed on said metallic core and including a base layer formed on said metallic core and a surface layer formed on said base layer, said at least two layers having a resistance between $1.57\times10^6$ Ω and $1.57\times10^9$ Ω for a unit length (1/cm), said surface layer having a volume resistivity between $1\times10^6$ Ω cm and $1\times10^9$ Ω cm.

6. A method for effecting sequential transfer of a toner image formed on an image carrier to a recording medium comprising:

a) forming a toner image on an image carrier;

b) transferring said toner image to an endless intermediate image transfer body; and c) transferring said toner image from said endless intermediate image transfer body to a recording medium using an image transfer roller, wherein said image transfer roller comprises:

i) a metallic core; and ii) at least two layers formed on said metallic core and including a base layer formed on said metallic core and a surface layer formed on said base layer, said at least two layers having a resistance between $1.57\times10^6$ Ω and $1.57\times10^9$ Ω for a unit length (1/cm), said surface layer having a volume resistivity between $1\times10^6$ Ω cm and $1\times10^9$Ω cm.

* * * * *